United States Patent [19]

Sansone

[11] 4,391,215

[45] Jul. 5, 1983

[54] SELF COMPENSATING OPTOELECTRONIC PLY AND EDGE DETECTOR FOR SEWING MACHINE

[75] Inventor: Eugene A. Sansone, Belle Meade, N.J.

[73] Assignee: The Singer Company, Stamford, Conn.

[21] Appl. No.: 303,660

[22] Filed: Sep. 18, 1981

[51] Int. Cl.[3] ..... D05B 69/26; D05B 69/20

[52] U.S. Cl. ..... 112/275

[58] Field of Search ..... 112/275, 277, 272, 121.11, 112/121.12, 2, 153

[56] References Cited

U.S. PATENT DOCUMENTS

| | | | |
|---|---|---|---|
| 3,302,600 | 2/1967 | Cheron . | |
| 3,924,550 | 12/1975 | Boser et al. . | |
| 4,038,931 | 8/1977 | Kosrow et al. . | |
| 4,160,424 | 7/1979 | Newell | 112/275 |
| 4,359,953 | 11/1982 | Martell et al. | 112/275 X |

FOREIGN PATENT DOCUMENTS 2918153 11/1980 Fed. Rep. of Germany ..... 112/272

OTHER PUBLICATIONS

Article "Today's Training Tool"—Mar. 1981, Bobbin Magazine—Chalmers.

*Primary Examiner*—Peter P. Nerbun

*Attorney, Agent, or Firm*—Edward P. Schmidt; Robert E. Smith; Edward L. Bell

[57] ABSTRACT

A light sensing device for a sewing machine with a sensing circuit which automatically compensates for the work fabric being utilized so as to be able to detect a ply change event in any fabric without requiring an operator adjustment for the type of fabric being stitched upon. Being able to detect a ply change event without the necessity for adjustment also permits automatic operation of certain sewing machine components, further facilitating operation of the sewing machine.

12 Claims, 9 Drawing Figures

SELF COMPENSATING OPTOELECTRONIC PLY AND EDGE DETECTOR FOR SEWING MACHINE

DESCRIPTION

Background of the Invention

This invention is in the field of sewing machines; more particularly, it is concerned with a fabric ply and edge detector which would assist a sewing machine operator in work manipulation on a sewing machine by detection of an edge of a work material or of a change in number of fabric plies.

It frequently occurs in the stitching of a work material by stitch count, as is accomplished with the automatic stitching equipment disclosed in the U.S. Pat. No. 4,092,937, which issued on June 6, 1978, to Landau Jr. et al, that variations in stitch count may be necessary due to, for example, a cumulative change in stitch length resulting from feeding variations, or fabric stretch, or for any of a variety of other reasons. It frequently becomes necessary to accommodate for errors due to irregular cuts, or inaccurate placement of the first stitch by the sewing machine operator. Many times, stitching will not terminate at the end of a work material but will terminate inwardly from the end thereof. Such a situation ensues when a pocket is stitched to a shirt front.

What is required is an edge detector which is sensitive to the termination of a fabric panel to initiate only so many stitches as will provide a selective margin from this termination; and then place the sewing machine in a condition for pivot. Ideally, such an edge detector will be self compensating so as to be able to detect an edge through multiple plies of fabric or, alternatively, through a single ply of fabric without operator intervention.

SUMMARY OF THE INVENTION

The objects of the invention are realized by locating a phototransistor sensor in the throat plate of the sewing machine longitudinally aligned with the needle aperture. A light source is mounted on a sewing machine in such a way as to illuminate the stitching area and, in particular, the phototransistor sensor. A sensing circuit is provided for the output of the phototransistor sensor which measures incident light as a DC level and is responsive on an AC level to a change in incident light due to, for example, a change in fabric ply. Thicker material would change the DC level of incident light to automatically set the trip point on a final output stage of the sensing circuit. A change in level due to a change in ply results in an AC output which is referred to this DC level to initiate an action suitable to the change in ply. Thus, the output from the sensor initiates a counter preset to establish a desired margin from the change in ply. At the end of count, a signal from the counter may stop the sewing machine with the needle in a position through a work material so that the an operator may, selectively, pivot the work material; or initiate a trim and wipe at the completion of stitching.

DESCRIPTION OF THE DRAWINGS

The invention comprises the devices, combinations and arrangements of parts hereinafter set forth and illustrated in the accompanying drawings of a preferred embodiment of the invention, from which the several features of the invention and the advantages attained thereby will be readily understood by those skilled in the art:

Referring now to FIG. 1, there is shown a head end portion of an industrial sewing machine 10 including a portion of the bracket arm 12, head end 14 and work supporting surface 16 of the bed thereof. The head end portion includes the usual presser bar 18 which terminates in a presser foot 20 and is situated behind a needle bar 22 which terminates in a sewing needle 24. The sewing needle 24 extends through an orifice 27 provided therefor in a throat plate 26 which is supported by the work supporting surface 16 of the bed (see also FIG. 2). Adjacent the throat plate 26 there is situated a bed slide 30 for providing operator access to sewing instrumentalities (not shown) situated within the bed of the sewing machine below the work supporting surface 16 thereof.

Figure 1:
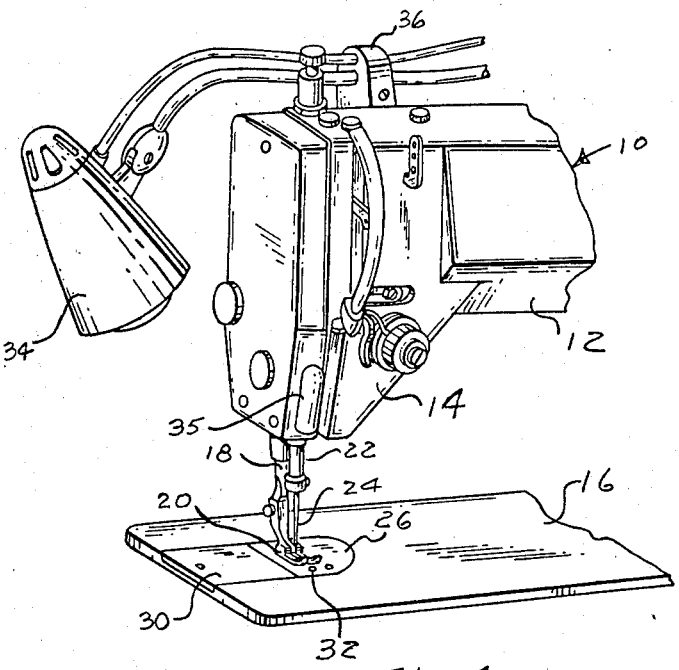
FIG. 1 is a perspective view of a head end portion of a sewing machine to which the invention has been applied.
Figure 2:
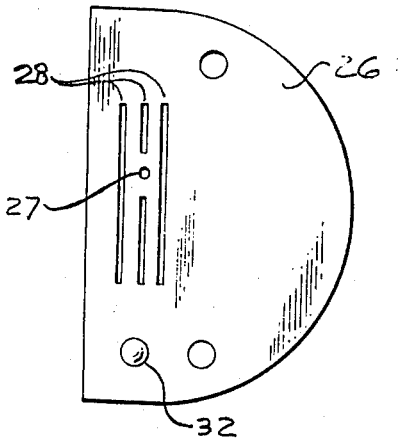
FIG. 2 is a plan view of the throat plate in the sewing machine of FIG. 1 showing the position of the sensor therein.

Referring in particular to FIG. 2, there is shown the throat plate 26 with the orifice 27 therein for accommodating passage of the needle 24. The throat plate 26 is also formed with slots 28 for accommodating feeding dogs (not shown) part of a feeding system (not shown) which may be any of many varieties well known to those skilled in the art, for feeding a work material beneath the sewing needle 24 to effect a line of stitching therein. Situated forwardly of the orifice 27 for accommodating the needle 24, there is a light sensing device such as a phototransistor sensor 32 to be used for a purpose more fully explained below. The phototransistor sensor 32 is, ideally, of a variety having a wide spectral response over the visible to infrared range in order to avoid, the filtering out of certain frequencies by fabrics having different colorations. A suitable phototransistor sensor 32 may be implemented, for example by model number H23A1 of the General Electric Company. A source of light for the phototransistor sensor 32 is provided by a lamp 34 clamped to the bracket arm 12 by a bracket 36 and a second lamp 35 retained in such a position on the head end 14 as to insure illumination of the phototransistor sensor 32. Either lamp 34 or lamp 35 may be a source of light for the phototransistor sensor 32, or other ambient light sources may be used as will be described below.

Figure 3:
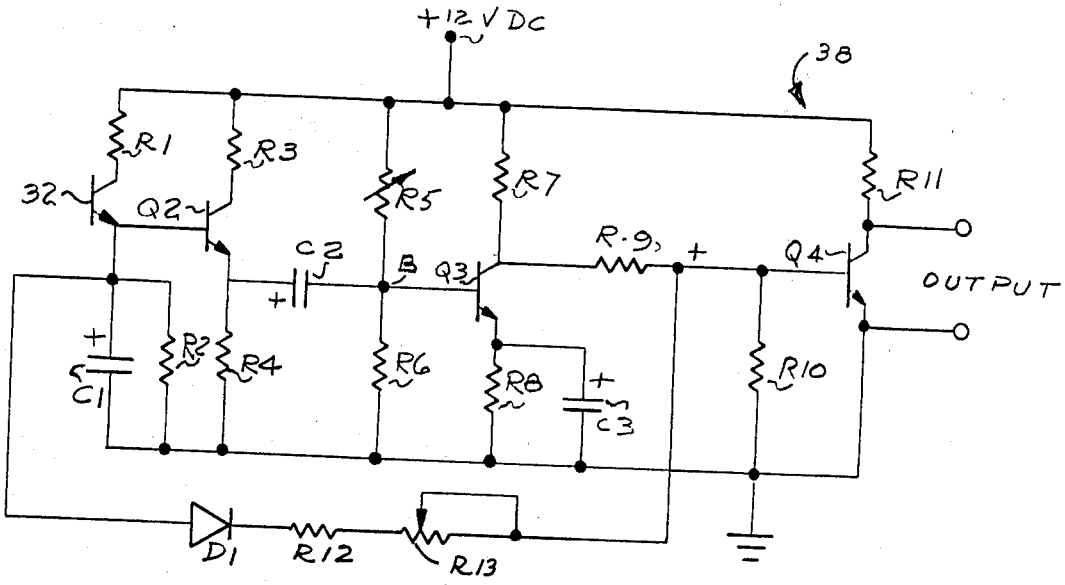
FIG. 3 is schematic of the circuit used with the sensor shown in FIGS. 1 and 2.

Referring now to FIG. 3, a schematic of a sensor circuit 38 for the phototransistor sensor 32 is shown. The phototransistor 32 conducts when it receives incident light from exposure to ambient light. Ambient light may be derived from lamps 34, 35 and/or external room light and/or sun light, which passes as incident light to the phototransistor sensor 32 directly or through fabric resting upon the work supporting surface 16. With the phototransistor sensor 32 receiving incident light, a DC voltage originating from the +12 VDC source is impressed across the capacitor C1 and resistor R2. The DC voltage, as averaged by the capacitor C1, represents the average light seen by the phototransistor sensor 32. Capacitor C1 serves the additional purpose of filtering the 60 hertz component which may be emitted by ambient light.

Transistor Q2 is connected in emitter follower configuration to phototransistor sensor 32, and is used as a buffer stage to transistor Q3 to which it is coupled for transmission of alternating current only by means of capacitor C2. Transistor Q3 is an alternating current amplifier using emitter degeneration by means of capacitor C3 and resistor R8. Transistor Q3 is biased by adjustment of variable resistance R5 so that it is normally not conducting thereby driving transistor Q4 into saturation. Transistor Q4 is biased to be a switch with its emitter connected to a circuit common so as to obtain a usable signal for a control circuit. A direct current forward loop network, consisting of diode D1, resistor R12 and variable resistor R13, applies a DC level to the base of transistor Q4 representative of average material thickness. Resistor R13 provides a factory adjustment to compensate for normal variations in specific phototransistor sensor 32 used.

In operation, with work fabric supported on the work supporting bed 16 and covering the phototransistor sensor 32, ambient light strikes the work fabric and incident light reaching the phototransistor sensor causes the phototransistor sensor to conduct in accordance with the amount of incident light. The voltage developed across the capacitor C1 and resistor R2 represents the incident light level and depends on the amount of room light, the amount of light available from the lamps 34 and 35, and the weight and color of the work fabric. The direct current forward loop network applies the voltage developed across the capacitor C1 and the resistor R2 directly to the base of the transistor Q4, automatically setting the bias point for transistor Q4 making it more sensitive for low incident light and less sensitive for high incident light. For example, a high density fabric covering phototransistor sensor 32 severely reduces the level of incident light thereon and, accordingly, there is a low voltage from the forward loop network applied to the base of transistor Q4. For a given number of fabric plies the light penetrating the work fabric is cyclic due to the effect of each individual thread, and the low AC level on the base of transistor Q3 resulting from the cyclic incidence is compensated for by the low voltage on the base of transistor Q4. A change of ply event for the high density fabric has only a moderate effect on light incident on phototransistor sensor 32 and, therefore, produces only a limited capability of transistor Q3 to divert current from the base of transistor Q4 which would indicate a ply change event. Thus, a low base bias voltage for transistor Q4 is desirable for a high density fabric. Conversely, a sheer work fabric will pass a great deal of light to phototransistor sensor 32 with larger cyclic incidence of light thereto, and a change in ply event may double or halve the incident light; thus, a high base bias voltage from the direct current forward loop network to transistor Q4 is necessary to maintain saturation thereof during cyclic incidence of light on the phototransistor sensor 32, and a high base bias voltage is easily overcome by the ability of transistor Q3 with a large AC voltage on the base thereof to divert current. As the work fabric is being fed over the phototransistor sensor 32, a decrease in the number of fabric plies will cause an increase in the light passing through the fabric, resulting in an increasing voltage at the emitter of phototransistor sensor 32. This increasing voltage is seen by capacitor C2 as an AC signal and is thereby coupled to transistor Q3. Transistor Q3 conducts during the voltage increase, diverting base current from transistor Q4 and allowing transistor Q4 to be cut off during the time of the voltage increase, resulting in a positive pulse which is used to signal that a ply change event has occurred.

Figure 4:
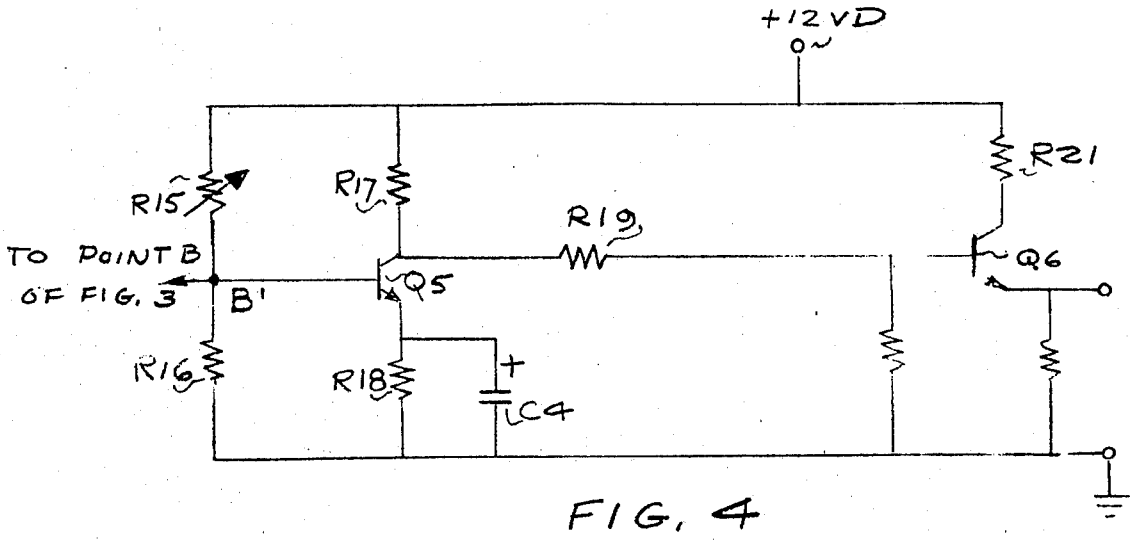
FIG. 4 is a schematic of a circuit which may be used with the circuit shown in FIG. 3 to detect an increase in the number of fabric plies.

Conversely, as the work material is being fed over the phototransistor sensor 32, an increase in fabric ply will cause a sharp decrease in the light transmitted through the work material, resulting in a decreasing voltage at the emitter of phototransistor sensor 32. Such a condition exists, for example, at the start of the seam, and may be used to initiate a signal indicating a need for a backtack sequence. The decreasing (negative) voltage excursion is seen by capacitor C2 as an AC signal, and is coupled to transistor Q3 driving it further into cutoff and insuring that transistor Q4 remains saturated. The result is that there is no signal output due to an increase in work fabric ply from the circuit of FIG. 3. In order to obtain an output signal which may be used to signal the necessity for an automatic presser foot lift for loading a work fabric or for an initial backtack, the circuit of FIG. 4 may be added as indicated to that of FIG. 3. In the circuit of FIG. 4, the output of the capacitor C2 is applied at point B′ to the base of transistor Q5 which is maintained normally saturated by adjustment of bias resistance R15. The decreasing voltage excursion seen by capacitor C2 as an AC signal is coupled to transistor Q5 and moves transistor Q5 towards cutoff and out of saturation for the duration of the excursion. The negative pulse on the base of transistor Q5 permits a positive pulse from the +12 volt supply through the resistors R17 and R19 to the base of transistor Q6. Transistor Q6 outputs a pulse on its emitter according to the size of the pulse through resistor R17 and R19. Conversely, a positive pulse at point B′, from a decrease in the number of fabric plies, will maintain Q5 in saturation, and Q6 will not output a pulse.

Figure 5:
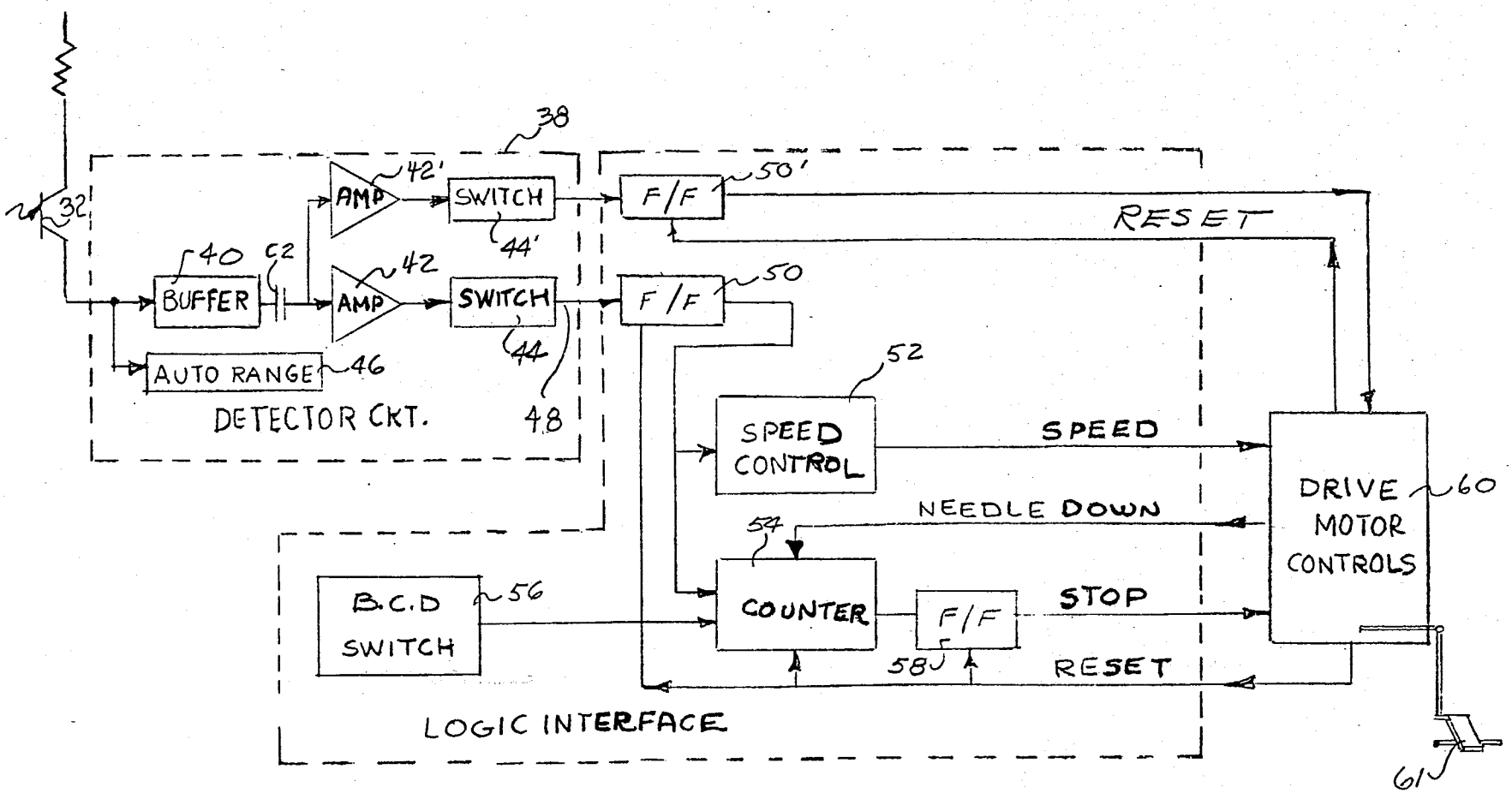
FIG. 5 is a block diagram showing the connection of the sensor circuits to the sewing machine logic.

Referring now to FIG. 5, there is shown in block diagrammatic form the sensor circuit 38 shown in FIG. 3 into which the phototransistor sensor 32 feeds. In the block diagram, the buffer 40 is implemented by the transistor Q2. The capacitor C2 is shown interposed between the buffer 40 and the AC amplifier 42 which is representative of transistor Q3. The switch 44 is implemented by the transistor Q4, and autorange 46 is implemented in the sensor circuit by the first forward loop network of diode D1, and resistors R12 and R13. The output from the sensor circuit 38 is transferred via line 48 to a flip-flop 50 which is set by a positive pulse indicative of a change in plies. The output of the flip-flop 50 is supplied to a speed control 52 to reduce the sewing machine speed, and to a counter 54 to initiate a count. The counter 54 counts up on a needle down position signal and therefor counts stitches. The count for the counter 54 is established by a binary coded decimal (B.C.D.) switch 56, and establishes the number of stitches to be effected after the edge of the work material is detected. The phototransistor sensor 32 is located a number of stitches away from the orifice 27 in the throat plate 26, and the B.C.D. switch 56 establishs a margin for the fabric panel being stitched upon. The end of count signal from the counter 54 actuates the flip-flop 58 which may thereupon initiate a signal to drive motor control 60 to stop the sewing machine 16 at needle down position. Provision may be made to require the sewing machine operator to return a sewing machine treadle 61 to neutral before continuing to sew or initiating a trimming action. The neutral position of the treadle 61 is used to reset the flip-flops 50 and 58 and the counter 54 so as to ready the sewing machine for a subsequent sewing operation.

It will be apparent to those skilled in the art that provision may be made to recognize an increase in fabric ply as an initial step to control presser foot lift, while recognizing a reduction in fabric plies as the location of a pivot point in which the sewing machine stops with the sewing needle in the work material thereof, which pivot stop may be converted into backtack, trim and wipe operation by the action of the sewing machine operator reversing the treadle in order to initiate this action. The circuit shown in FIG. 4 may be added to that shown in FIG. 3 to obtain a second amplifier 42', and switch 44'. Thus, when a work fabric is introduced to the sewing machine and the phototransistor sensor 32 is covered to reduce its incident light, the reduction in incident light is detected by circuitry as disclosed in FIG. 4, which circuitry sets a flip-flop 50' shown in FIG. 5, which flip-flop 50' sends out a command signal to the drive motor control 60 to raise the presser foot 20. Action by the sewing machine operator to advance the sewing machine treadle 61 to a forward position to initiate stitching will lower the presser foot 20, as well as reset the flip-flop 50'. Logic in the drive motor control 60 would be effective to prevent elevation of the presser foot 20 when the foot treadle 61 is in a forwardly depressed state to avoid raising the presser foot while stitching over an increase in the number of plies. It is also apparent that logic may be provided as part of the drive motor control 60 which also responds to an increase in work fabric plies by automatically initiating backtacking on a sew command from a sewing machine operator.

Figure 6A:
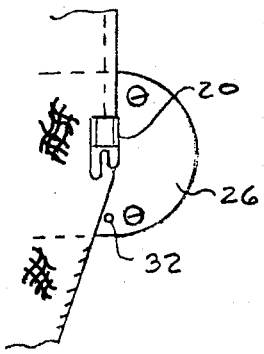
FIG. 6*a* and *b* are, respectively, examples of incorrect and correct fabric feed to indicate the potential of the sensor for determining and responding to a fault; and, FIG. 7*a* and *b* are examples of, respectively, detection of a quality defect and potential for stitching of a fabric piece which is invisible to the operator.
Figure 6B:
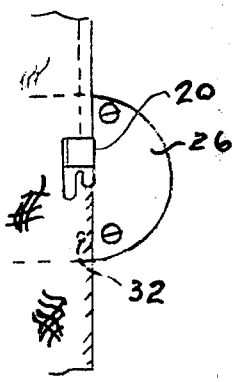
Figure 7A:
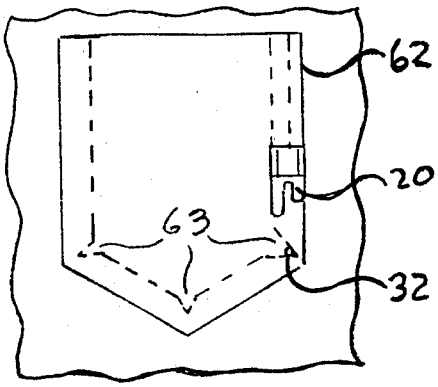

Referring to FIGS. 6*a* and *b*, there are shown examples of how the phototransistor sensor 32 is actually utilized. In FIG. 6*a*, the work fabric is folded slightly as it is being fed beneath the presser foot 20 thereby exposing the sensor 32. When the sensor 32 is exposed, as was explained above, the sewing machine speed may be reduced and succeeding stitches are counted and the sewing machine is stopped. Thereupon, the sewing operator may take corrective action to straighten the fold in the work material or, if a valid edge has been encountered, may initiate a pivot prior to continuing stitching in a new direction. In FIG. 6*b*, the normal sequence in straight stitching is shown which insures that the phototransistor sensor 32 will be unexposed until the end of the seam is encountered. In FIG. 7*a*, there is depicted a pocket piece 62 for stitching on, for example, a shirt front. The pocket piece 62 depicted contains a quality defect 63 which is not apparent to the sewing machine operator. However, the phototransistor sensor 32 responds to a change in ply to stop operation of the sewing machine, thereby alerting a sewing machine operator that pocket piece 62 having a quality defect 63 is being utilized.

Figure 7B:
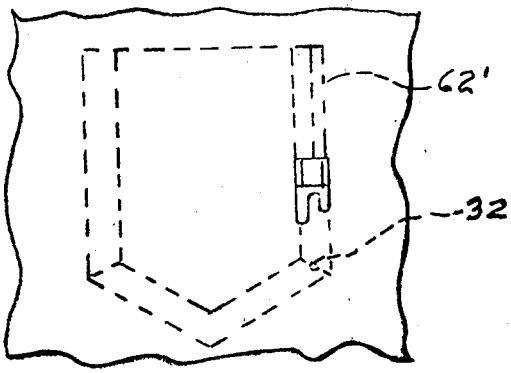

In FIG. 7*b*, a pocket piece 62' is depicted not having a quality defect but situated on the reverse side of a work material and invisible to a sewing machine operator. Stitching on the pocket piece 62' may proceed from the reverse side, with the phototransistor sensor 32 signalling to the sewing machine operator at the proper point that a pivot turn must be made when the sensor detects a change in ply indicative of the end of the pocket piece.

Thus has been described an optoelectronic fabric ply and edge detector which is self compensating to permit a change in the work material being operated upon to take place without necessitating any adjustments of the sensor or circuitry therefor. By virtue of the direct current forward loop network implemented by the diode D1, and resistors R12, R13, the transistor Q4 becomes more sensitive at low incident light conditions when heavy fabrics are being utilized, and is less sensitive during high ambient light conditions when sheer fabrics are being utilized. Thus, the sensitivity of the circuit varies with the need for sensitivity. The capacitor C1 is sized large enough to average incident light in order to develop an average DC level as well as to filter out the AC component from an AC light source. Capacitor C2 is sized substantially smaller than capacitor C1, for faster response; and is only for the purpose of blocking DC from transistor Q3.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

I claim:

1. A self compensating fabric ply and edge detector for a sewing machine having a frame including a work supporting bed, said frame supporting a needle bar for endwise reciprocation, a sewing needle fastened to one end of said needle bar, a throat plate, a needle accommodating orifice extending through said throat plate, a loop taker supported beneath said throat plate for cooperation with said sewing needle extending through said needle accommodating orifice in the formation of stitches, means for feeding a work fabric through said sewing machine beneath said sewing needle, said fabric ply and edge detector comprising: a light sensing device, means for supporting said light sensing device in said work supporting bed before said needle accommodating orifice in the direction of feed of said work fabric, a source of light for said light sensing device, means for establishing a DC level related to average light reaching said light sensing device, means for passing an AC component of a change in incident light reaching said light sensing device, means for variably diverting current in response to said AC component from said passing means, means for supplying current related to said average light for diversion by said diverting means, and means for initiating a selected response on diversion of current by said diverting means substantially greater than that related to said average light.

2. A self compensating fabric ply and edge detector as claimed in claim 1 wherein said establishing means further comprises a first capacitor connected to the output of said light sensing device, said first capacitor being of a size to average said output of said light sensing device and maintain an average DC level related to said output.

3. A self compensating fabric ply and edge detector as claimed in claim 2 wherein said passing means further comprises a second capacitor for passing as an AC signal a variation in output of said light sensing device.

4. A self compensating fabric ply and edge detector as claimed in claim 3 wherein said variable current diverting means further comprises a transistor having the base thereof connected to said second capacitor and biased to be conducting proportionally only to an AC component from said passing means.

5. A self compensating fabric ply and edge detector as claimed in claim 4 wherein said current supplying means further comprises a DC forward loop network connecting said first capacitor to said first transistor whereby current diversion from AC components related to fabric variability are compensated for.

6. A self compensating fabric ply and edge detector as claimed in claim 5 wherein said initiating means further comprises a second transistor connected as a switch, a voltage source connected to said second transistor to drive said second transistor into saturation and provide for flow of current therethrough, said first transistor being connected for diverting saturating voltage from said second transistor due to an AC component received by said first transistor greater than that related to fabric variability, thereby driving said second transistor into cutoff so as to obtain a pulse from said power source.

7. A self compensating fabric ply and edge detector as claimed in claim 6 wherein said sewing machine further includes a drive motor control including a foot treadle, said drive motor control further including means for sensing needle position, selective means for terminating stitching with said sewing needle in a selected up position out of said work fabric and down position through said work fabric, and means for regulating speed, and wherein said initiating means further comprises a logic interface including a first flip flop, a speed control, a counter, and a second flip flop, wherein said first flip flop is responsive to a pulse received from said power source to cause said speed control to issue a low speed command to said drive motor control and to initiate a count in said counter of the needle down positions sensed by said drive motor control, and, upon termination of said count, said counter sets said second flip flop to issue a command to said drive motor control to terminate stitching with said sewing needle in a down position through said work fabric.

8. A self compensating fabric ply and edge detector for a sewing machine having a frame including a work supporting bed, said frame supporting a needle bar for endwise reciprocation, a sewing needle fastened to one end of said needle bar, a throat plate, a needle accommodating orifice extending through said throat plate, a loop taker supported beneath said throat plate for cooperation with said sewing needle extending through said needle accommodating orifice in the formation of stitches, means for feeding a work fabric through said sewing machine beneath said sewing needle, a presser foot, means for selectively supporting said presser foot in and out of engagement with said work fabric and feeding means, said fabric ply and edge detector comprising a light sensing device, means for supporting said light sensing device in said work supporting bed before said needle accommodating orifice in the direction of feed of said work fabric, a source of light for said light sensing device, means for passing an AC component derived from a change in incident light reaching said light sensing device, a power source, means biased for normally diverting current from said power source but responsive to a decreasing voltage excursion from said passing means for not diverting current from said power source, and means responsive to the duration of said decreasing voltage excursion for initiating a selected response.

9. A self compensating fabric ply and edge detector as claimed in claim 8 wherein said means for passing an AC component comprises a capacitor for passing as an AC signal a variation in output of said light sensing device.

10. A self compensating fabric ply and edge detector as claimed in claim 9 wherein said current diverting means is implemented by a transistor having said AC component applied to the base thereof, and biased by said power source to be saturated in the absence of an AC component and to be driven towards cutoff on a decreasing voltage excursion from said passing means.

11. A self compensating fabric ply and edge detector as claimed in claim 10 wherein said initiating means is implemented by a second transistor maintained in a nonconductive state by said fist transistor diverting current from said power source but responsive to a non-diversion of current by said first transistor upon a decreasing voltage excursion from said passing means to permit a positive pulse from said power source to pass through said second transistor, and a flip flop responding to said positive pulse to change its state.

12. A self compensating fabric ply and edge detector as claimed in claim 11 wherein said sewing machine further includes a drive motor control and a foot treadle therefor, said drive motor control further including means for actuating said presser foot supporting means to a selected position in and out of engagement with said work fabric and feeding means, and wherein said change of state of said flip flop will set said drive motor control to actuate said actuating means for said presser foot supporting means to support said presser foot out of engagement with said work fabric and feeding means.

* * * * *